United States Patent [19]

Taylor

[11] Patent Number: 4,987,912

[45] Date of Patent: Jan. 29, 1991

[54] WALKER ASSEMBLY HAVING STABILIZER MEANS

[75] Inventor: George P. Taylor, 274 Hazel, Glencoe, Ill. 60062

[73] Assignee: George P. Taylor, Glencoe, Ill.

[21] Appl. No.: 531,517

[22] Filed: May 31, 1990

[51] Int. Cl.[5] ..... A61H 3/00

[52] U.S. Cl. ..... 135/67; 248/351; 297/310

[58] Field of Search ..... 135/65, 67, 77, 84; 248/351; 280/755; 297/5, 6, 310; 272/70

[56] References Cited

U.S. PATENT DOCUMENTS

| | | | |
|---|---|---|---|
| 547,198 | 10/1895 | Bimeler | 297/310 |
| 1,628,949 | 5/1927 | Catherine . | |
| 1,972,557 | 9/1934 | Greene . | |
| 2,331,801 | 6/1974 | Pivacek . | |
| 2,708,473 | 5/1955 | Gable et al. | 135/67 |
| 2,792,874 | 5/1957 | Sundberg . | |
| 3,759,544 | 9/1973 | Korpela . | |
| 3,848,883 | 11/1974 | Breacain | 297/310 X |
| 4,123,102 | 10/1978 | Landry et al. | 297/310 X |
| 4,280,578 | 7/1981 | Perkins | 272/70 X |
| 4,387,891 | 6/1983 | Knochel | 135/67 X |
| 4,510,956 | 1/1985 | King . | |
| 4,521,105 | 4/1985 | Barker . | |
| 4,700,730 | 10/1987 | Samuelson et al. . | |
| 4,722,356 | 2/1988 | Rehder | 135/67 |
| 4,759,562 | 7/1988 | Vinyard et al. | 297/5 X |
| 4,886,294 | 12/1989 | Nahachewski | 280/755 |

*Primary Examiner*—David A. Scherbel
*Assistant Examiner*—Lan Mai
*Attorney, Agent, or Firm*—Sidney N. Fox

[57] ABSTRACT

Walker having four legged frame defining front and a pair of sides, each having a cross-bar. The invention provides a stabilizing bar secured to the front cross-bar to extend angularly forwardly at an acute angle to provide a non-tippable structure particularly while the user is using the walker as support during the act of assuming a sitting position or rising therefrom. The stabilizer bar can be adjusted as to length and, can be pivotally mounted so that it can be swingably maneuvered to be inactive when the walker is not being used.

25 Claims, 2 Drawing Sheets

Fig .1
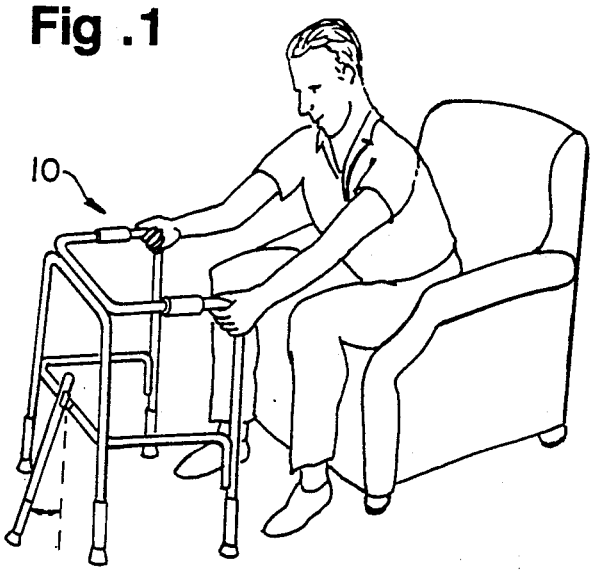
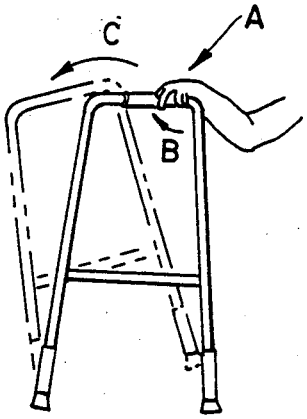
Fig. 3
Fig. 2
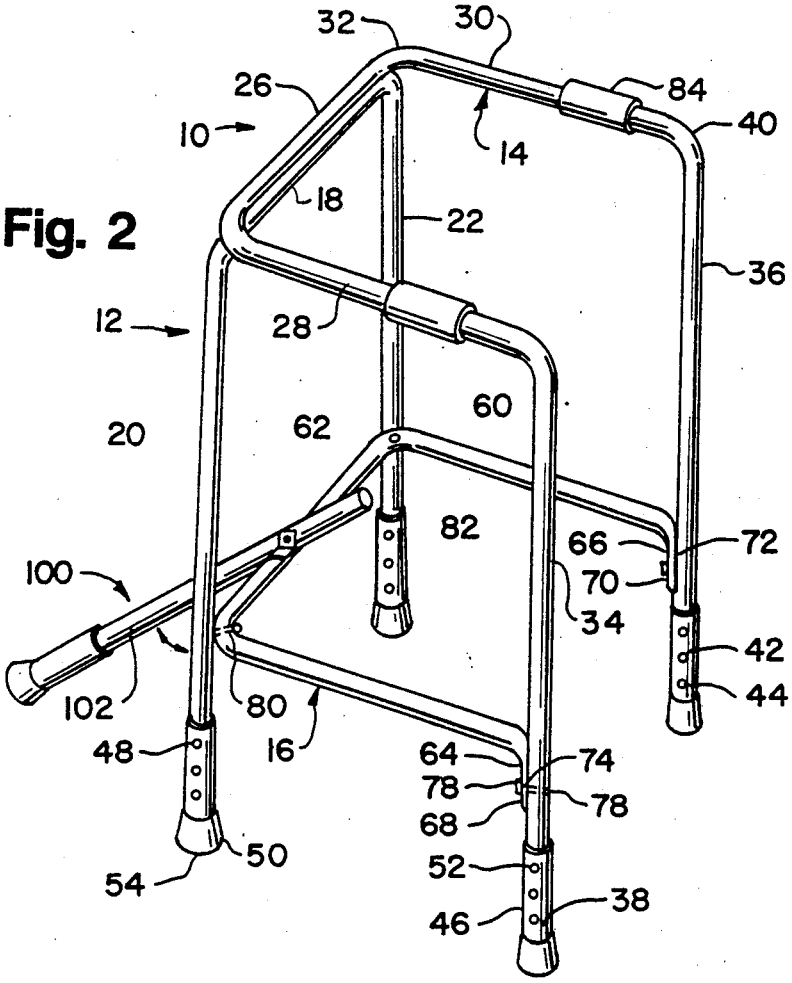

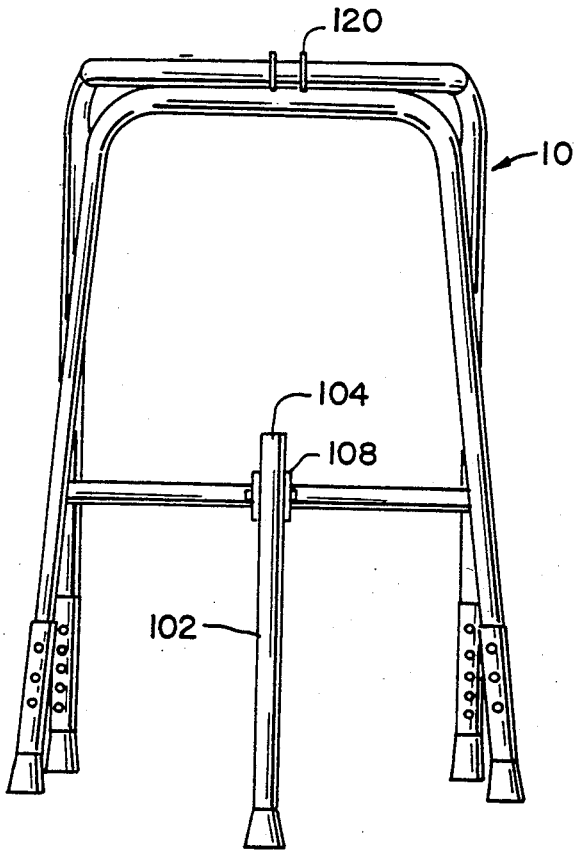
Fig. 4
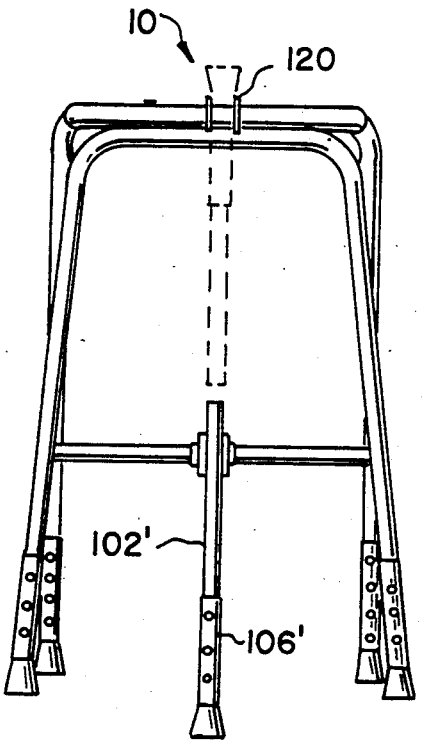
Fig. 5
Fig. 6
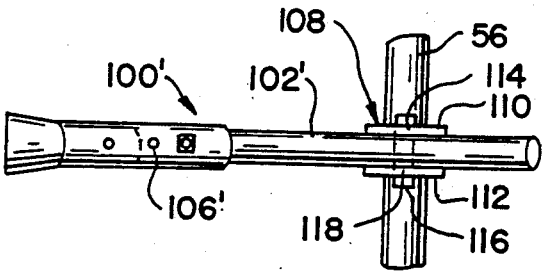

WALKER ASSEMBLY HAVING STABILIZER MEANS

This invention relates generally to walkers and more specifically provides a four legged walker having stabilizing means to prevent tipping thereof especially during the act of assuming of or rising from a sitting position so as to prevent injury to the user.

Accident prevention especially for the elderly is a serious need that demands attention. Each year thousands of elderly suffer falls which result in injuries ranging from severe bruising to hip fractures and worse. Psychological consequences including depression, anxiety, fear of leaving the home arise from the falls and the fear of falls. Restriction of common activies are common. Additionally, many younger individuals, even children, suffer from walking infirmities due to illness and recovery therefrom . . . all of which requiring the use of walking aids for mobility. In many instances, the walking aid required is a walker assembly.

Typical walkers comprise a four legged frame assembly formed preferably of rigid tubular front and side portions, each respectively defining front and side upper horizontal supports and having cross-members extending horizontally between the legs, said cross-members located intermediate the upper horizontal supports and the feet of the legs. The front and side portions are assembled to define a rearwardly opening U-shaped configuration, the user entering from the rear of the walker and grasping the side upper horizontal supports. The user then lifts the frame assembly and then replaces the frame assembly a slight distance while still remaining within the frame assembly. These acts are repeated in increments thereby providing a supporting aid to enable the user to ambulate forward while relying upon the walker for support and balance. The user can move forwardly by lifting and moving only one side at a time, rotating that side by pivoting the frame assembly about that foot remaining on the ground support surface, lifting and rotating each side alternately. Most patients can accomplish the necessary repetitive movements to enable movement along a relatively level ground support surface. The conventional walker has been considered satisfactory for most patient usage in normal "walking" activities.

Some users nevertheless have experienced difficulties in using the conventional walkers either because of their particular disabilities or the need to traverse uneven ground surfaces, curbs, cobble or brick surfaces, cinder or gravel surfaces and the like. Inorder to reduce the chances of injury and to facilitate use of the walker, it has been proposed to provide the front and/or rear legs thereof with ground engaging wheels, casters or gliders so that the walker can be moved forward, to the right or left, as the case may be, without requiring the user to lift the walker repeatedly. In instances where wheels are provided, some type of friction means have been proposed for disposition adjacent the wheels, preferably adjacent each leg, to serve as braking means so as to prevent "run-away" and to offer some degree of stability and control the rotation of the wheels. The wheels, and the like tend to render the walker unstable for many patients. With the more infirm, a great amount of force is exercised thereupon, tending to force the wheels suddenly to be displaced along the ground surface or be caught, say by a ridge, pothole or other irregularity in the ground surface. Further difficulties arise when the user attempts to transverse curbs. Nevertheless, wheeled walkers have become common and widely employed.

However, considerable walker instability has been encountered by users (patients) attempting to utilize the conventional (and/or wheeled) walker during the assumption of and/or rising from a sitting posture. For example, as one attempts to rise from a sitting posture (or condition), as from a chair or couch, the upper rear portion of the walker is grasped by the patient, the body weight of the patient being exercised thereat, with considerable force being applied at said rearward portions of the arms or top side horizontal portions of the walker assembly. Along with this force exercised in a downward vector, the patient also exercises a forward force vector component, pushing simultaneously with the downwardly directed force vector. This combination of forces urge the front feet of the walker assembly, in respect of the four legged assembly, to "dig" into the support surface or frictionally engage same. The resultant force vector is not only downwardly and forwardly directed, but effects an upward thrust, tending to propel the rear portion of the walker assembly upward and forwardly pivoting about its front feet, causing the patient to be pitched forward.

Likewise, in the course of the patient assuming a sitting posture from a standing posture, the patient adjusts position adjacent the chair or couch by moving incrementally backward, sensing the location of the front edge portion of the seat with the back of each calf. Once the front of the chair or couch is sensed, the patient self lowers and in the course thereof, thrusts downward on the rear portion of the side horizontal arm of the walker assembly and simultaneously, thrusts forwardly, pushing against that portion being grasped. The front feet again are caused forcably to engage the supporting ground surface, the walker being propelled forwardly and its rear portion being propelled upwardly, pitching the patient forward. Both occurances often cause serious injury to the patient. Note also, that both in the assumption of the sitting position and rising therefrom, the patient/user often is located rearward of the walker, i.e. outside the U-shaped area encompassed by the front and side portions of the walker assembly. This also contributes to the instability of the walker during the acts described. The effects of the friction means or braking means provided on wheeled walker assemblies often duplicate the difficulties encountered with the non-wheeled assembly during the activities described above.

Another safety expedient proposed is to provide brace means or struts on the front and/or rear legs, most often at each of the two front legs. Unfortunately, this expedient does not prevent tipping of the walker, as described, during the assumption of the seated position and/or during the patient's rise fron such seated position. The vector force exercised is uneven relative to the front portion of the walker assembly, greater force often being applied to one of the left or right brace impacts on the ground support surface, with the result that the walker is raised upwardly and forwardly at one side or the other of the walker assembly, with the resultant tipping of the walker.

Among prior art proposals offered to prevent and/or at least alleviate the problem of tipping experienced by users of walker assemblies, U.S. Pat. Nos. 4,251,105 (Barker) and 4,518,959 (King) are typical. The Barker patent provides a pair of forwardly projecting, downwardly angled struts having bottom friction plugs for engaging the ground surface in advance of the wheels provided secured to each front leg of a walker assembly. These struts do not prevent tipping, especially during the acts of rising from or assuming of a sitting position. King provides a pair of forwardly directed foreshortened leg portions at each front corner of a U-shaped portion as well as rearwardly directed downwardly angled foreshotened legs at the rear portion of the walker, both rear portions bearing wheels while a single wheel is provided midway between the corners of the front portion. Again, experience has shown that such expedient is no better than the Barker structure in preventing the type of instability described which occurs during the rise from and/or assumption of a seated posture by the patient/user.

Samuelson et al, U.S. Pat. No. 4,700,730 and Sundberg, U.S. Pat. No. 2,792,874 respectively provide rearwardly projecting brace means on each of the front legs, as well as a rearwardly mounted steering wheel (with friction means on mid-positioned spring-biased opposite legs) of wheeled walker devices.

Investigation apparently has not located any prior art teachings toward a solution to the problems described which have been encountered in the use of the walker assemblies, particularly those problems encountered during the use thereof as support while the patient/user rises from and/or descends to a seated posture. An effective, truly non-tipping walker assembly has been long sought but yet apparently unavailable as yet to the art.

SUMMARY OF THE INVENTION

The invention herein provides an effective, truly non-tippable four legged walker assembly including a front frame and a pair of rearwardly extending side frames assembled to form a U-shaped configuration, at least said front frame having a rigid, horizontal cross-member and a rigid stabilizer member fixedly secured to said cross-member at substantially the mid-portion thereof, said stabilizer member extending angularly downwardly and forward of said cross-member whereby to prevent tipping of said walker when same is employed to assist the user in assuming a seated posture and/or in rising from the seated posture.

BRIEF DESCRIPTION OF THE DRAWING

FIG. 1 is a reduced perspective view diagrammatically illustrating an individual using the walker assembly according to the invention for support;

FIG. 2 is a perspective view of a walker assembly constructed in accordance with the invention;

FIG. 3 is a reduced elevational diagrammatic view of a conventional walker assembly illustrating its instability as is likely to occur during the act of the user in rising from and/or assumption of a seated posture;

FIG. 4 is a front perspective view of a walker assembly constructed in accordance with the invention;

FIG. 5 is a reduced front perspective view of a walker assembly according to the invention illustrating the stabilizer means thereof in active and in inactive conditions; and FIG. 6 illustrates a modified embodiment of the stabilizer means according to the invention.

DESCRIPTION OF PREFERRED EMBODIMENTS

The walker assembly constructed in accordance with the invention comprises a four legged free standing frame formed preferably of rigid tubular aluminum members assembled to form a front frame and a pair of rearwardly side frames defining a rearwardly opening U-shaped configuration. The front frame has a cross-member rigidly secured to the pair of front legs and extending normal thereto spaced from the feet thereof. According to the invention, there is provided an elongate linear stabilizer member rigidly secured to said cross-member at a location substantially midway between the ends thereof so that it extends forwardly and angularly downward toward the ground surface proximate said surface but normally spaced therefrom. The stabilizer member can be either a linear elongate member or a curved member directly or otherwise secured to said cross-member, may be pivotally mounted thereto or can be mounted to a bracket secured fixedly to said cross-member. The stabilizer member can be provided with means for adjusting the forward extent thereof as well as the angle at which the stabilizer member is directed. The overall length of the stabilizer may be adjustable. The stabilizer member of the invention may be permanently secured to said cross-member, as by welding or may be removably secured thereto. Means can be provided for swinging said stabilizer to an inactive condition locked onto holding means provided on the front frame of the assembly. The stabilizer member functions to prevent tipping of the walker assembly, particularly while the user employs the said assembly for support during the act of assuming a seated posture and/or in the course of rising from a seated posture to a standing position.

Referring to the drawing, FIG. 1 and FIG. 2 respectively illustrate the invention as embodied in a walker assembly, FIG. 1 illustrating an individual employing the said assembly with respect to rising and/or assuming a seated posture and FIG. 2 illustrating the invention as embodied in a walker assembly 10 in more detail as formed of three sections assembled together and held by fastening means such as screws, pins, bolts or the like. The assembly 10 has a front frame section 12, a rearwardly extending section 14 and an intermediate section 16, all preferably formed of aluminum or steel tubing having a wall thickness and diameter to offer substantial rigidity. The front section 12 has a U-shaped configuration defining a horizontal mid-portion 18 and a pair of equal length front legs 20, 22 bent generally normal to the mid-portion 18 and having curved corners 24. The legs 20, 22 diverge one relative the other. The rearwardly extending section 14 also is formed of the same diameter tubing and is formed so that it has a horizontal mid-portion 26 and a pair of like, angularly bent portions 28, 30 generally of the same length and joined by curved corners 32. The portions 28,30 are each further bent to define generally parallel rear legs 34,36, each extending vertically one relative to the other vertically aligned and spaced generally equally one from the other at their free ends 38 and are curved at their junctures 40 with portions 28,30.

Each of the front legs 20,22 and rear legs 34,36 may be provided with a row 42 of longitudinally spaced through openings 44 along the lower ends thereof and said legs are telescopically engaged within closed end tubes 46. The tubes 46 are provided with an opening 48 and feet 50 at their closed end. The opening 48 is aligned with a selected one of the openings 44 and a bolt or pin 52 threaded therethrough so that the length of each respective leg can be adjusted, thereby enabling the height of the walker assembly 10 to be adjusted. The feet 50 carry friction means 54 on their bottom surface to prevent sliding when force is applied thereupon during use.

The intermediate section 16 of the walker assembly 10 is formed of a single length of tubing having substantially the same diameter as the tubing from which the front and rear sections 12 and 14 are formed. Section 16 is formed by bending to a U-shaped configuration having a mid-portion 56 and a pair of angular bent arms 58,60 joined by curved corners 62. The arms 58 and 60 are each bent at their free ends to form tubular portions 64 and 66. Portions 64,66 are collapsed longitudinally to define end sections 68,70 each having a concave portion 72, the curvature of which conforms to the curvature of the circumference of said legs 34,36 so as to seat same thereon. A passage 74 is formed through each said portion 72 and a passage 76 is formed through each leg 34,36 for receipt of a pin or bolt 78. Openings 80 are formed through corners 32 and 62 whereby the front and rear frames and intermediate section can be secured together by pins or bolts 82. When the walker assembly 10 is assembled, the mid-portion 56 defines the front cross-member of the walker assembly 10, the arms 58, 60 defining the cross-members of the side frames. Gripping means 84 can be provided on the upper horizontal arm portions of the side frames, such as plastic or rubber tubing, pads, etc., whereby a purchase is so provided.

The walker assembly 10 as described above is believed to have been satisfactory to permit an impaired person to possess mobility, enabling the person to move about, indoor and out of doors while enabling the negotiation of difference in surface topography such as cracks potholes, irregularity and the like without dangerous loss of stability. Smooth floor surfaces or carpeted surfaces should offer little difficulty. Wheels can be provided to improve mobility.

However, when a person having a mobility impairment such as a walking disability, attempts to assume a sitting posture from a standing condition, the person holds onto the walker assembly 10 and edges incremently backward, tenatively, until the proximity to the front edge of the chair or couch is sensed, as by the back portion of the person's calf touching said edge. Supported by the arms (the upper horizontal side frame portions) of the walker assembly 10, the person tenatively moves rearward, gradually leaving the envelope defined by the U-shaped configuration of the walker assembly 10. The weight of the person engaging in the act of assuming a seated posture from a standing condition exacts a downward force against the rear corner portions 40, the person tightly gripping same with the body weight directed downwardly, slightly rearwardly toward the seat. The person exerts a force downwardly and yet pushes simultaneously against the rear corners 40 of the walker assembly 10. This occurs as the person moves the grasping engagement toward said rear portion of the walker assembly and lowers the body toward said chair or couch. Force is exercised downwardly (see arrow A in FIG. 3). Simultaneously, force is exerted forwardly (see arrow B in FIG. 3). The person also pushes against the rear corners 40 of the walker assembly. The front feet of the walker assembly 10 are urged to "dig" into and exercise a frictional force against the ground surface. The net resultant, i.e. the combination of said forces, cause the walker assembly to be pitched upwardly and forwardly, pivoting same at the front feet, along with the movement upwardly, destabilizing the walker assembly, tipping same upwardly and forwardly simultaneously, (see arrow C in FIG. 3), with the result that the user is thrown or pitched forwardly, most often with resulting injury but for the stabilizer means 100,100' provided as a part of the walker assembly 10.

A similar situation occurs when the user attempts to rise from a seated posture to an upright, standing posture employing the walker assembly 10 as supporting means. In rising, the user applies a downward force and, simultaneously, applies a forward force, each at the rear corner of the walker assembly. As force is exercised, the portion of the walker assembly grasped by the user is raised and pitched forward. The walker assembly 10 without the stabilizer means provided thereon according to the invention herein would be destabilized and the disabled user thrown or pitched forward.

The destabilization effects described above occur without the stabilizer means included as a part of the walker assembly 10. The stabilizing means illustrated in FIGS. 1, 2 and 3 as installed as a part of walker assembly 10 is illustrated in greater detail but slightly modified in FIG. 6 and installed in FIG. 5 and is designated therein therein by reference characters 100, 100' respectively. The stabilizing means 100, 100' is formed of an elongate linear bar 102 in FIGS. 1, 2 and 3 and 102' in FIGS. 5 and 6 respectively. The stabilizing means 100, 100' is formed preferably of rigid tubular material, clamped or otherwise rigidly (firmly) secured on the front horizontally arranged cross-member 56 of the walker assembly 10 at a location substantially midway between its ends. The placement of the bar 102, 102' at a location substantially midway along cross-member 56 is significant in preventing forward tipping of the walker 10. Similar struts placed on or closely adjacent to each of the legs have not been found to prevent tipping, particularly in the situations described herein. The bar 102 extends forwardly and downwardly at an angle relative to the cross-member 56, preferably said angle being between 20 to 45 degrees toward the ground surface but is secured so as to extend just short of said ground surface. The bar 102 is joined to the cross-member 56 at a location on said bar 102 spaced from the upper end 104 of said bar 102. A pair of diametrically opposed openings 106 are formed on said stabilizer bar 102. A clamp 108 is provided for securement to said cross-member 56 and has a pair of upstanding lugs 110,112 spaced one from the other a distance to accommodate the tubular bar 102, 102' therebetween. A pair of passageways 114 is formed in the upstanding lugs 110,112 and the bar 102 is introduced between said lugs. The openings 106 are aligned with passageways 114 and a pin or bolt 116 passed therethrough. The pin 116 may be enclosed in an outer sleeve 118 which serves as a bearing permitting a limited rotation of the stabilizer bar from a position forward of the walker assembly 10 to a position clamped onto clamps 120 which can be provided on the upper horizontal portion 18 of the front frame 26 of said walker assembly 10. The passageway 106 may be supplemented by additional passageways 106' arranged in a row longitudinally along the bar 102 to permit adjustment of the length of the bar when installed. The extension of the bar 102 is selected so that the bar 102 extends toward the ground surface small distance from engagement therewith so as not to interfere with the use of the walker assembly 10 as a walking support.

The stabilizer means 100, 100' provided by the invention can be employed independently of any particular walker assembly structure, wheeled or not, other than the particular walker assembly described herein, and can be easily fabricated and installed at low cost to solve the problems encountered during seating and rising as described hereinabove. It should be understood that the stabilizer means according to the invention may be installed on any walker structure and that the invention herein is not limited to the walker structures described and illustrated herein.

The stabilizer bar 102, 102' may as well be formed of other than tubular material. Angle members, solid bars, T and I configured members are effective functionally in the same manner as tubular members 102,102' described above. The essential feature of the invention herein is to provide a walker assembly with stabilizing means to prevent such tipping as described hereinabove and to provide stabilizing means of the character described capable of being employed with any walker structure wheeled or not to provide the non-tipping benefit.

It should be understood that changes and variations may be made by one skilled in the art in form and detail without departing from the spirit and scope of the invention as claimed hereinafter.

What is claimed is:

1. A walker assembly comprising a four legged frame of generally U-shaped configuration having at least a cross-member secured rigidly between the front legs thereof, stabilizer means secured on said cross-member at a location generally midway between the ends of said cross-member and extending forwardly and angularly downwardly of said cross-member toward the ground surface whereby to impact against said surface during assumption of and rising from a seated posture by the user of said walker preventing tipping of said walker assembly.

2. The walker assembly as claimed in claim 1 in which said stabilizer member is linear.

3. The walker assembly as claimed in claim 1 in which said stabilizer member is pivotally secured on said cross-member.

4. The walker assembly as claimed in claim 1 in which said stabilizer member is formed of a tubular material.

5. The walker assembly as claimed in claim 3 in which said stabilizer member is linear.

6. The walker assembly as claimed in claim 1 and means selectively to adjust the length of said stabilizer member.

7. The walker assembly as claimed in claim 1 in which said stabilizer member is a bar.

8. The walker assembly as claimed in claim 1 and means frictionally engaging the ground surface, said means located at each of the front legs thereof.

9. The walker assembly as claimed in claim 1 in which said stabilizer member is secured on said cross-member at a location midway between the front legs of said walker assembly.

10. The walker assembly as claimed in claim 1 in which said stabilizer member is pivotally secured on said cross-member at a location midway between the opposite ends thereof.

11. A walker assembly comprising a front frame and a pair of side frames each having a rear portion assembled to define a generally U-shaped rearwardly opening configuration, said assembly having at least a pair of front legs and a pair of rear legs, said front frame including at least a horizontal rigid cross-member, a stabilizing member secured on said cross-member and extending forwardly, angularly downwardly relative to said cross-member toward the supporting ground surface but spaced therefrom, said stabilizer member capable of impacting against the supporting ground surface upon exercise of a downward and forward force simultaneously against the rear portion of the side frames whereby to prevent tipping of the walker assembly while the user assumes a seated posture from a standing position and rises therefrom while utilizing said walker assembly for support.

12. The walker assembly as claimed in claim 11 in which the stabilizer member is secured on said cross-member at a location between the ends of said stabilizer and at a location along said cross-member midway between the front legs of said walker assembly.

13. The walker assembly as claimed in claim 11 in which said stabilizer member is secured on said cross-member at a location along said cross-member midway between the legs of said front frame.

14. The walker assembly as claimed in claim 11 in which said stabilizer member extends downwardly at an angle between 20 and 45 degrees relative to said cross-member.

15. The walker assembly as claimed in claim 11 in which said stabilizer member is tubular.

16. The walker assembly as claimed in claim 11 in which said stabilizer member is cylindrical in configuration.

17. The walker assembly as claimed in claim 11 in which said stabilizer member extends forwardly of said front frame with its forward end reaching just short of the supporting ground surface whereby to impact thereon only upon exercise of simultaneously applied downward and forward force upon the rear portions of said walker assembly.

18. The walker assembly as claimed in claim 11 in which said stabilizer member is pivotally secured on said cross-member at a location midway between the ends of said cross-member, said stabilizer member capable of being swingably moved upwardly and means to hold said stabilizer member at the front frame after said swingable movement.

19. The walker assembly as claimed in claim 11 in which said stabilizer member has means thereon for adjusting the length thereof.

20. A stabilizer member for removable rigid attachment to a four legged walker assembly of the type having a front frame and a pair of side frames defining a generally U-shaped configuration, there being a cross-member between the front legs of said assembly, said stabilizer member comprising an elongate length of linear rigid material and having means for rigid removable securement on said cross-member at a location substantially midway between the ends thereof for disposition extending forwardly and angularly downwardly relative to said front frame to place the end of said stabilizer member proximate but spaced from the surface supporting said walker assembly, said stabilizer member capable of impacting upon said supporting surface when force is applied simultaneously in a downward, forward direction upon the rear portions of said walker assembly to prevent tipping of said assembly while the user assumes and/or rises from a seated posture using said walker assembly for support.

21. The stabilizer member as claimed in claim 20 in which said member is generally cylindrical in configuration.

22. The stabilizer member as claimed in claim 20 in which said member is formed of tubular material.

23. The stabilizer member as claimed in claim 20 in which said member is a bar.

24. The stabilizer member as claimed in claim 20 and means for pivotally mounting same on said cross-member.

25. The stabilizer member as claimed in claim 20 in which said member is fixedly secured to said cross-member.

* * * * *